US008733757B2

(12) United States Patent
Oshiro et al.

(10) Patent No.: US 8,733,757 B2
(45) Date of Patent: May 27, 2014

(54) SHEET PROCESSING APPARATUS, SHEET CONVEYING PATH OPENING METHOD, AND ERASING APPARATUS

(75) Inventors: Toshiaki Oshiro, Shizuoka (JP); Isao Yahata, Shizuoka (JP); Takahiro Kawaguchi, Shizuoka (JP); Yoshiaki Sugizaki, Shizuoka (JP); Kikuo Mizutani, Shizuoka (JP); Hiroyuki Taki, Shizuoka (JP); Hiroyuki Tsuchihashi, Shizuoka (JP); Chiaki Iizuka, Shizuoka (JP); Hidetoshi Yokochi, Shizuoka (JP); Ken Iguchi, Shizuoka (JP); Hiroyuki Hazu, Shizuoka (JP); Yoichi Yamaguchi, Shizuoka (JP); Hiroyuki Sugiyama, Shizuoka (JP); Yuichi Saito, Shizuoka (JP)

(73) Assignees: Kabushiki Kaisha Toshiba, Minato, Tokyo (JP); Toshiba Tec Kabushiki Kaisha, Shinagawa, Tokyo (JP)

( * ) Notice: Subject to any disclaimer, the term of this patent is extended or adjusted under 35 U.S.C. 154(b) by 146 days.

(21) Appl. No.: 13/529,773

(22) Filed: Jun. 21, 2012

(65) Prior Publication Data

US 2013/0001050 A1 Jan. 3, 2013

Related U.S. Application Data

(60) Provisional application No. 61/502,243, filed on Jun. 28, 2011, provisional application No. 61/563,002, filed on Nov. 22, 2011.

(51) Int. Cl.
*B65H 7/02* (2006.01)
*B65H 33/04* (2006.01)

(52) U.S. Cl.
USPC ..... 271/258.05; 271/293; 270/52.15; 270/58.03; 250/589; 235/484

(58) Field of Classification Search
USPC ..... 271/258.05, 293, 294; 270/52.15, 270/58.03; 250/589; 235/475, 484
See application file for complete search history.

(56) References Cited

U.S. PATENT DOCUMENTS 4,124,203 A * 11/1978 Muller ..... 270/52.2
4,875,668 A * 10/1989 Spyra ..... 270/45
5,527,025 A * 6/1996 Schlough ..... 270/58.06
5,533,719 A * 7/1996 Crowley et al. ..... 270/52.09

(Continued)

FOREIGN PATENT DOCUMENTS

JP 04-039234 2/1992

*Primary Examiner* — Douglas Hess
(74) *Attorney, Agent, or Firm* — Patterson & Sheridan, LLP

(57) ABSTRACT

A sheet processing apparatus includes: a conveying member configured to convey a sheet; a first opening section including a conveyance guide section arranged on the opposite side of the conveying member across a conveying path and configured to form the conveying path and a first pivot shaft configured to pivotably support the conveyance guide section, the first opening section being configured to form the conveying path using the conveyance guide section if changing to a closed state and open the conveying path if changing to an open state; and a second opening section including a cover section configured to cover the first opening section if the first opening section changes to the closed state and a second pivot shaft configured to pivotably support the cover section, the second opening section being configured to cause, if pivoting, the first opening section to pivot following the second opening section.

17 Claims, 9 Drawing Sheets

(56) References Cited

U.S. PATENT DOCUMENTS

| | | | | |
|---|---|---|---|---|
| 5,615,876 | A * | 4/1997 | Yergenson et al. | 271/258.01 |
| 5,911,416 | A * | 6/1999 | Klopfenstein | 271/223 |
| 6,290,410 | B1 * | 9/2001 | Sunada et al. | 400/624 |
| 6,464,449 | B1 * | 10/2002 | Takeno | 414/791.2 |
| 6,830,241 | B1 * | 12/2004 | Klopfenstein | 270/52.25 |
| 7,232,122 | B2 * | 6/2007 | Mayer et al. | 271/4.01 |
| 7,250,622 | B2 * | 7/2007 | Nakajo et al. | 250/588 |
| 7,404,558 | B2 * | 7/2008 | Kanome | 271/258.05 |
| 7,484,731 | B2 * | 2/2009 | Gutierrez-Vazquez et al. | 271/258.04 |
| 7,571,902 | B2 * | 8/2009 | Carter et al. | 270/52.2 |
| 8,011,657 | B2 * | 9/2011 | Kiyosumi | 271/265.01 |
| 8,162,307 | B2 * | 4/2012 | Taki et al. | 270/58.12 |
| 8,251,361 | B2 * | 8/2012 | Taki et al. | 270/58.12 |
| 8,326,204 | B2 * | 12/2012 | Won | 399/367 |

* cited by examiner

SHEET PROCESSING APPARATUS, SHEET CONVEYING PATH OPENING METHOD, AND ERASING APPARATUS

CROSS-REFERENCE TO RELATED APPLICATIONS

This application is based upon and claims the benefit of priority from the prior the U.S. Patent Application No. 61/502,243, filed on Jun. 28, 2011, and the prior the U.S. Patent Application No. 61/563,002, filed on Nov. 22, 2011, and the entire contents of which are incorporated herein by reference.

FIELD

Embodiments described herein relate generally to a sheet processing apparatus, a sheet conveying path opening method, and an erasing apparatus.

BACKGROUND

There is an erasing apparatus that erases an image from a sheet subjected to image formation. The erasing apparatus includes an erasing section that applies heating treatment to a sheet, on which an image is formed with a decolorable coloring material, to erase a color of the image (the coloring material) on the sheet. The erasing apparatus further includes a reading section that reads the image on a surface of the sheet. The erasing apparatus makes, on the basis of the image read by the reading section, a determination whether the sheet to be subjected to erasing processing is erasable and a determination whether the erasing processing is successful.

The reading section of the erasing apparatus reads respective images on a first surface and a second surface of a conveyed sheet. The reading section of the erasing apparatus includes, for example, two reading units arranged to be opposed to each other along a sheet conveying path and enables duplex reading of the images on the conveyed sheet.

In the erasing apparatus to which the sheet is conveyed, a jam is likely to occur in anyplace in the sheet conveying path. Therefore, the sheet conveying path of the erasing apparatus needs to be opened in order to remove a jammed sheet even in a place of the sheet conveying path where the reading section is arranged.

On the other hand, not only the erasing apparatus but also a sheet processing apparatus including a sheet conveying path for conveying a sheet to the inside of a machine body conveys the sheet through the sheet conveying path and performs various kinds of processing. The jam is likely to occur in anyplace in the sheet conveying path. Therefore, the sheet conveying path needs to be opened in order to remove the jammed sheet.

However, if an opening section to be pivoted in order to open the conveying path is thick, irrespective of in which portion of the opening section a fulcrum of the pivoting for opening is provided, it is likely that the sheet conveying path may not be able to be opened sufficiently wide.

Specifically, if the fulcrum of the pivoting is provided outward with respect to the opening section, it is difficult to secure a space in which the opening section pivots. On the other hand if the fulcrum of the pivoting is provided inward with respect to the opening section, a housing interferes with the sheet conveying path and makes it difficult to open the sheet conveying path sufficiently wide.

DETAILED DESCRIPTION

Throughout this description, the embodiments and examples shown should be considered as exemplars, rather than limitations on the apparatus and methods of the present invention.

A sheet processing apparatus, a sheet conveying path opening method, and an erasing apparatus according to an embodiment of the present invention are explained in detail below with reference to the accompanying drawings.

The sheet processing apparatus according to this embodiment includes: a conveying member configured to convey a sheet; a first opening section including a conveyance guide section arranged on the opposite side of the conveying member across a conveying path for conveying the sheet and configured to form the conveying path and a first pivot shaft configured to pivotably support the conveyance guide section, the first opening section being configured to form the conveying path using the conveyance guide section if changing to a closed state and open the conveying path if changing to an open state; and a second opening section including a cover section configured to cover the first opening section if the first opening section changes to the closed state and a second pivot shaft configured to pivotably support the cover section, the second opening section being configured to cause, if pivoting, the first opening section to pivot following the second opening section.

An erasing apparatus is explained below as an example of the sheet processing apparatus.

Figure 1:
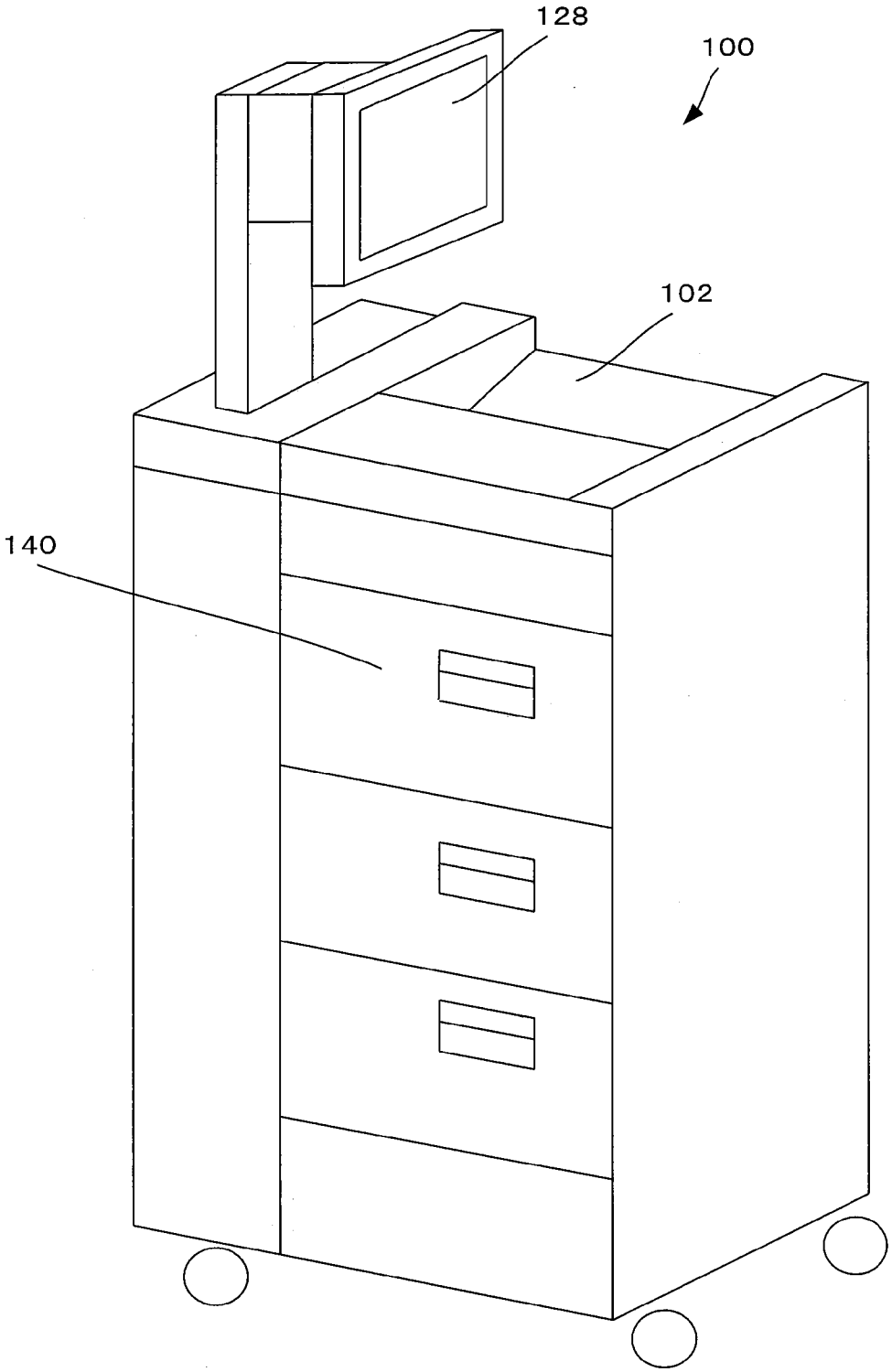
FIG. 1 is an external perspective view of an erasing apparatus.

FIG. 1 is an external perspective view of an erasing apparatus 100. As shown in FIG. 1, the erasing apparatus 100 includes an operation section 128, which is an input and output device, a paper feeding tray 102 on which sheets to be processed are stacked, and an opening section 140 that opens a sheet conveying path.

Figure 2:
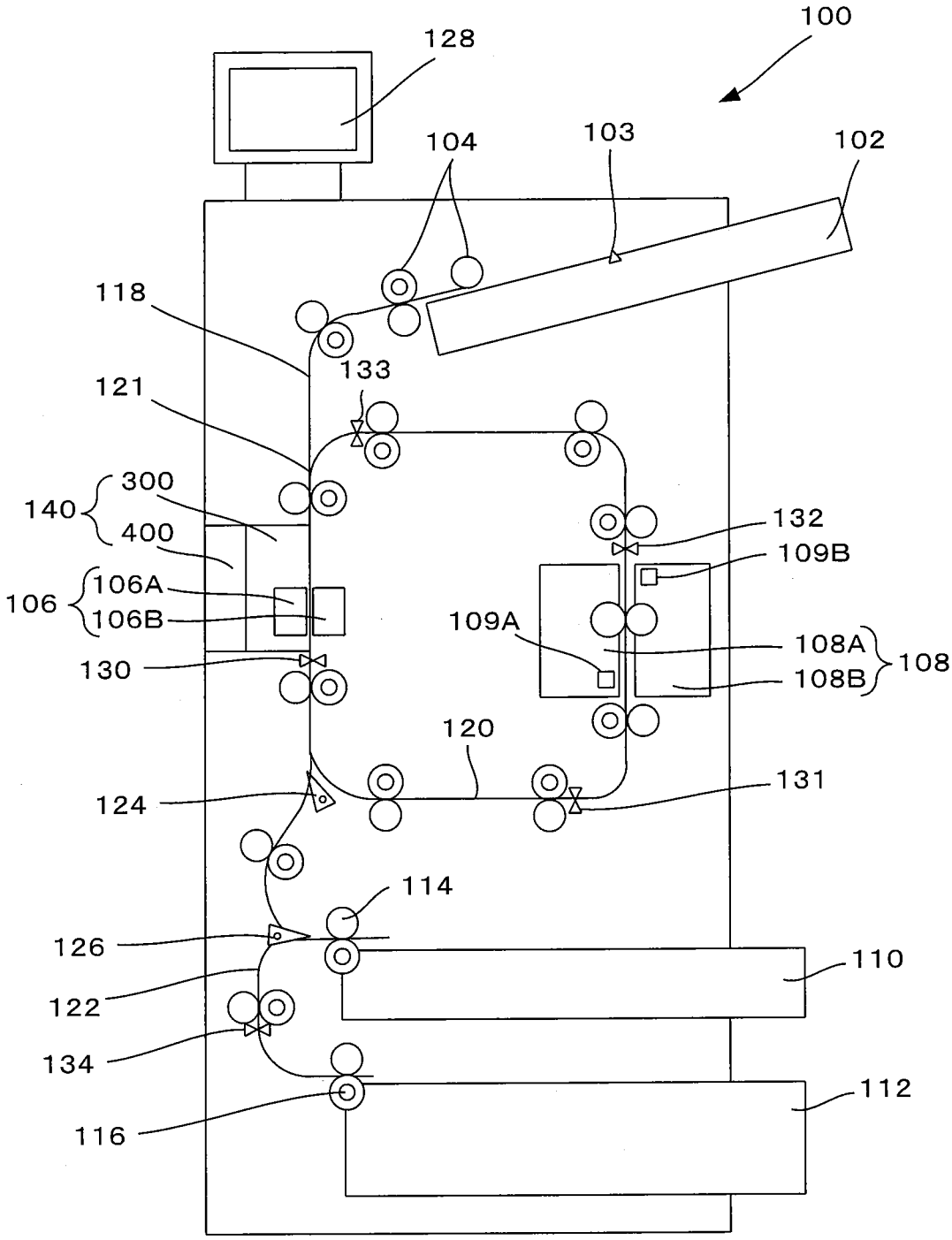
FIG. 2 is a side view of a main part of the erasing apparatus.

FIG. 2 is a schematic diagram for explaining the configuration of the erasing apparatus 100. The erasing apparatus 100 applies "decoloring processing", to a sheet on which an image is formed with a "decolorable coloring material" such as a decolorable toner or decolorable ink, for erasing a color of the image formed by the decolorable coloring material (hereinafter simply referred to as a recording material).

The erasing apparatus 100 includes the paper feeding tray 102, a paper feeding member 104, a reading section 106, an erasing section 108, a reuse tray 110, a reject tray 112, discharge members 114 and 116, a first conveying path 118, a second conveying path 120, a third conveying path 122, a first diverting member 124, a second diverting member 126, the operation section 128, and the opening section 140.

Sheets to be reused are stacked on the paper feeding tray 102. Sheets of various sizes such as A4, A3, and B5 are stacked on the paper feeding tray 102. The sheets stacked on the paper feeding tray 102 are, for example, sheets subjected to image formation with a recording material that is decolored by being heated to a temperature equal to or higher than a predetermined temperature.

The paper feeding member 104 includes a pickup roller, a sheet feeding roller, and a separating roller arranged to be opposed to the sheet feeding roller. The paper feeding member 104 feeds the sheets on the paper feeding tray 102 to the first conveying path 118 on the inside of the erasing apparatus 100 one by one.

The paper feeding tray 102 includes a detection sensor 103 that detects presence or absence of the sheet on the paper feeding tray 102. The detection sensor 103 may be, for example, a micro sensor or a micro actuator.

The first conveying path 118 forms a conveying path extending from the paper feeding tray 102 to the reuse tray 110. The first conveying path 118 conveys the fed sheet to the reading section 106 or the reuse tray 110.

The reading section 106 is arranged along the first conveying path 118 downstream in a sheet conveying direction with respect to the paper feeding tray 102. The reading section 106 includes a reading unit such as a CCD (Charge Coupled Device) scanner or a CMOS sensor.

In this embodiment, the reading section 106 reads respective images on a first surface and a second surface of the conveyed sheet. Specifically, the reading section 106 includes a first reading unit 106A and a second reading unit 106B arranged along and across the first conveying path 118 and enables duplex reading of the images on the conveyed sheet. A position where each reading unit of the reading section 106 reads the image on the sheet is referred to as a reading position.

The images read by the reading section 106 are stored in a storing section 210 (see FIG. 3) explained below.

For example, images on a sheet read by the reading section 106 before being subjected to the decoloring processing are converted into an electronic form and stored in the storing section 210, whereby, if data of the decolored images is necessary, the image data can be acquired. A control section 200 explained below determines, on the basis of the images read by the reading section 106, whether the sheet is a decolorable sheet or not, or a reusable sheet or not.

The erasing apparatus 100 includes, downstream of the reading section 106, the first diverting member 124 as a switching section.

The first diverting member 124 switches a conveying direction of the conveyed sheet. The first diverting member 124 conveys the sheet, which is conveyed through the first conveying path 118, to the second conveying path 120 or the reuse tray 110.

The second conveying path 120 branches from the first conveying path 118 at a branch point where the first diverting member 124 is arranged. The second conveying path 120 branching from the branch point conveys the sheet to the erasing section 108. The second conveying path 120 merges with the first conveying path 118 at a merging point 121 further upstream in the sheet conveying direction than the reading section 106. In other words, the second conveying path 120 merges with the first conveying path 118 at the merging point 121 between the paper feeding tray 102 and the reading section 106.

Therefore, the second conveying path 120 makes it possible to convey the sheet, which is conveyed from the reading section 106, to the reading section 106 again through the erasing section 108. In other words, the erasing apparatus 100 can control the first diverting member 124 to convey the sheet, which is fed from the paper feeding member 104, to the reading section 106, the erasing section 108, and the reading section 106 in this order.

The first conveying path 118 includes the second diverting member 126 downstream of the first diverting member 124. The second diverting member 126 leads the sheet, which is conveyed from the first diverting member 124, to the reuse tray 110 or the third conveying path 122. The third conveying path 122 conveys the sheet to the reject tray 112.

The erasing section 108 erases the color of the images on the conveyed sheet. For example, in a state in which the erasing section 108 is in contact with the conveyed sheet, the erasing section 108 heats the sheet to a predetermined decoloring temperature to thereby erase the color of the images formed on the sheet with the recording material.

For example, the erasing section 108 of the erasing apparatus 100 according to this embodiment includes two decoloring units 108A and 108B respectively for decoloring the first surface and the second surface of the sheet. The decoloring units 108A and 108B are arranged to be opposed to each other across the second conveying path 120.

The decoloring unit 108A comes into contact with the sheet from one surface side of the sheet and heats the sheet. The decoloring unit 108B comes into contact with the sheet from the other surface side of the sheet and heats the sheet. In other words, the erasing section 108 erases the images on both the surfaces of the conveyed sheet in one conveyance. A position where each of the decoloring units 108A and 108B heats the sheet, i.e., a heating section (not shown) included in each of the decoloring units 108A and 108B applies heat to the conveyed sheet and erases the color of the image is referred to as a decoloring position.

The erasing section 108 includes temperature sensors 109A and 109B that respectively detect temperatures of the heating sections of the decoloring units 108A and 108B. The temperature sensors 109A and 109B may be either a contact type or a noncontact type.

The operation section 128 arranged in an upper part of a main body of the erasing apparatus 100 includes a display section of a touch panel type and various operation keys.

The operation keys include, for example, a ten key, a stop key, and a start key. A user instructs, via the operation section 128, a functional operation of the erasing apparatus 100 such as the start of decoloring or reading of an image on a sheet to be decolored.

The operation section 128 displays setting information, an operation status, or log information of the erasing apparatus 100 or a message to the user. The operation section 128 is not limited to an operation section arranged in the main body of the erasing apparatus 100. For example, the operation section 128 may be configured to be capable of being operated from an operation section of an external apparatus connected to the erasing apparatus 100 via a network. Alternatively, the operation section 128 may be formed independently from the main body of the erasing apparatus 100 and configured to operate the erasing apparatus 100 through wired or wireless communication. The operation section 128 in this embodiment only has to be an operation section with which, for example, the user can instruct the erasing apparatus 100 to perform processing and can view information.

The discharge members 114 and 116 discharge sheets to the reuse tray 110 and the reject tray 112 vertically arranged in a lower part of the main body. For example, a sheet made reusable with an image thereon erased is stacked on the reuse tray 110. A sheet determined as unreusable is stacked on the reject tray 112. In the following explanation, the reuse tray 110 is referred to as a reuse tray and the reject tray 112 is referred to as a reject tray.

The sheets to be received by the reuse tray 110 and the reject tray 112 can be interchanged. Setting concerning what kinds of sheets are stacked on the respective trays, i.e., setting of conveyance destination of sheets only has to be set from, for example, the operation section 128. According to this setting, the second diverting member 126 switches the conveying path and leads the conveyed sheet to the reuse tray 110 or the third conveying path 122.

A conveying route for the sheet is changed as appropriate on the basis of a processing mode executed by the erasing apparatus 100. The erasing apparatus 100 includes plural processing modes. The erasing apparatus 100 includes, for example, (1) a first decoloring mode for performing only the decoloring processing without performing image reading, (2) a second decoloring mode for performing the decoloring processing after reading an image, (3) a third decoloring mode for carrying out discrimination (discrimination processing) of reusability of the sheet after the decoloring processing without performing reading processing before decoloring, (4) a fourth decoloring mode for carrying out the decoloring processing after reading an image and further carrying out the discrimination processing, and (5) a reading mode for carrying out the reading processing for an image without performing image decoloring.

The user can select the respective modes on the operation section 128 of the erasing apparatus 100. The selection of the processing modes is not limited to be executed on the operation section 128 of the erasing apparatus 100. The processing modes may be set from an external terminal. In the first to fourth decoloring modes, the sheet is always conveyed to the erasing section 108.

On the other hand, in the reading mode, the erasing apparatus 100 controls the first diverting member 124 to discharge the sheet through the reading section 106 without conveying the sheet to the erasing section 108.

The erasing apparatus 100 includes plural sheet detection sensors 130, 131, 132, 133, and 134 that detect the sheet conveyed through the first to third conveying paths 118, 120, and 122. The sheet detection sensors may be, for example, micro sensors or micro actuators. The sheet detection sensors are arranged in appropriate positions of the conveying paths.

The opening section 140 includes a first opening section 300 that includes the first reading unit 106A arranged outward with respect to the first conveying path 118 and forms a conveying path for the sheet and a second opening section 400 that faces the outer side of the erasing apparatus 100 and covers the first opening section 300.

Figure 3:
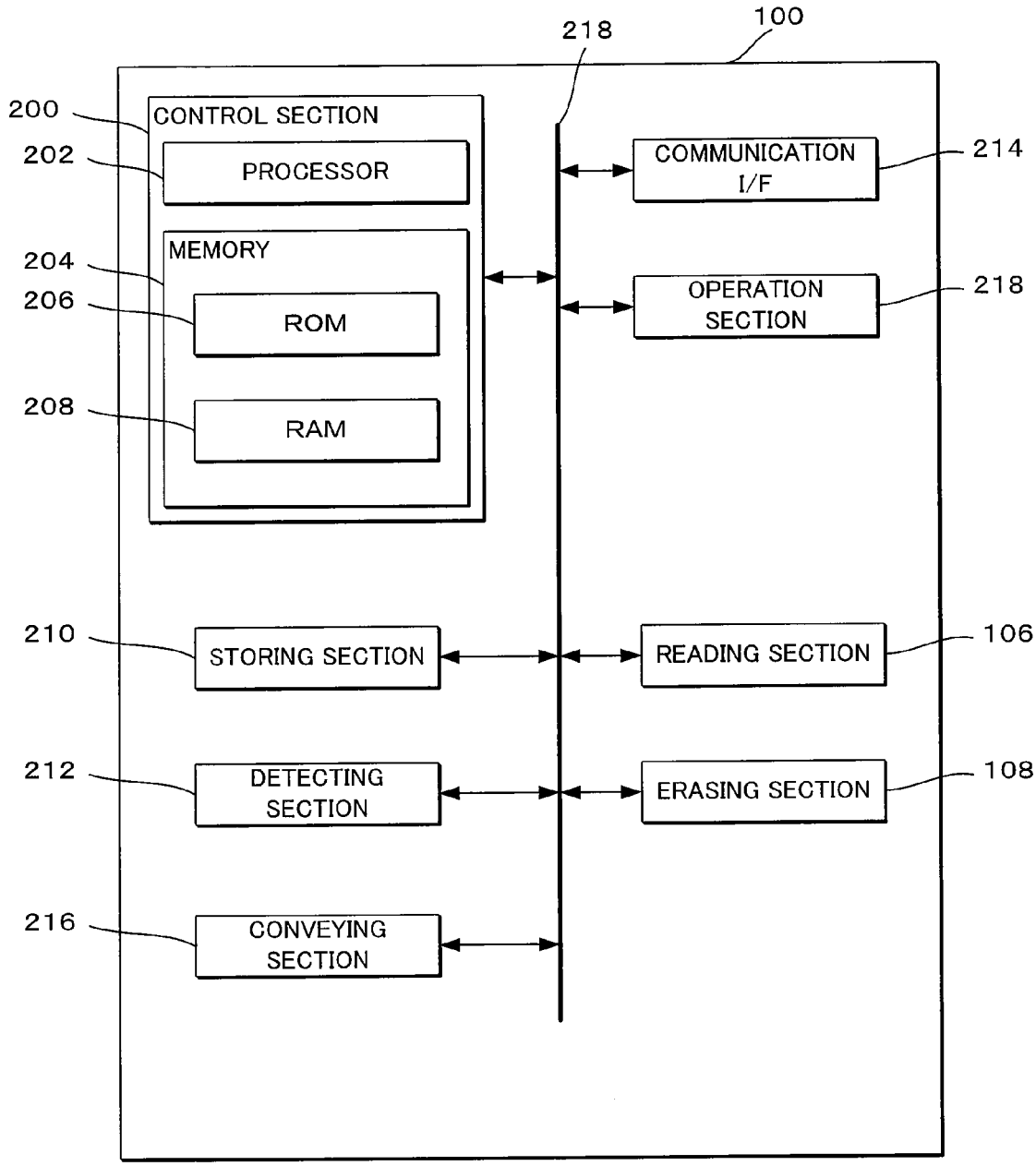
FIG. 3 is a block diagram for explaining a hardware configuration of the erasing apparatus.

FIG. 3 is a block diagram for explaining a hardware configuration of the erasing apparatus. The erasing apparatus 100 includes the control section 200, the storing section 210, a detecting section 212, a communication interface (communication I/F) 214, a conveying section 216, the reading section 106, the erasing section 108, and the operation section 128.

The control section (a controller) 200 includes a processor 202 including a CPU (Central Processing Unit) or an MPU (Micro Processing Unit) and a memory 204.

The control section 200 controls the reading section 106, the erasing section 108, and the operation section 128. The memory 204 is, for example, a semiconductor memory and includes a ROM (Read Only Memory) 206 storing therein various control programs and a RAM (Random Access Memory) 208 that provides the processor 202 with a temporary work area.

For example, the ROM 206 stores therein a printing ratio of a sheet set as a threshold for reusability, a density threshold for determining whether an image is decolored, and the like. The RAM 208 may temporarily store an image read by the reading section 106. The respective components of the erasing apparatus 100 are connected via a bus 218.

The control section 200 controls the reading section 106, the erasing section 108, and the other components according to, for example, the processing modes (1) to (5) set on the operation section 128.

If the first to fourth decoloring modes are selected, the control section 200 causes the erasing section 108 to erase an image on a sheet. If the reading section 106 reads the sheet before the sheet is conveyed to the erasing section 108 (the second decoloring mode and the fourth decoloring mode), the control section 200 stores an image read by the reading section 106 in the storing section 210 (hereinafter, reading processing).

The control section 200 may determine whether prohibited data, decoloring of which should be prohibited, such as confidential data is included in data of a sheet image read by the reading section 106.

Alternatively, the control section 200 may determine whether a printing ratio of the read image on the sheet exceeds the threshold. If the data, decoloring of which should be prohibited, is included or the printing ratio exceeds the threshold, the control section 200 conveys the sheet to the reject tray 112.

On the other hand, if the data, decoloring of which should be prohibited, is not included or the printing ratio does not exceed the threshold, after reading the image on the sheet, the control section 200 conveys the sheet to the erasing section 108.

After the erasing section 108 decolors the image on the sheet, if the reading section 106 reads the decolored image on the sheet (the third decoloring mode and the fourth decoloring mode), the control section 200 determines, on the basis of data of the image read by the reading section 106, whether the sheet is reusable.

The control section 200 determines, on the basis of a result of the determination, a conveying destination of the sheet (hereinafter, discrimination processing). The discrimination processing for determining whether the sheet is reusable includes processing for determining whether an image is present on the sheet. For example, if a sheet subjected to the decoloring processing in the erasing section 108 is read and an image remaining without being erased is present, the control section 200 determines that the sheet is unreusable because the unerased image is present. Alternatively, the discrimination processing includes processing for determining whether the sheet is reusable on the basis of the read image and on the basis of a state such as presence or absence of a fold of the sheet, crease depth, and an opened hole.

If the reading mode for reading an image without performing image decoloring is set, the control section 200 controls the diverting member 124 to not lead, after the reading section 106 reads the image on the sheet, the sheet to the erasing section 108 and stores the image read by the reading section 106 in the storing section 210.

The control section 200 controls the components on the inside of the apparatus on the basis of a signal from the detecting section 212. The detecting section 212 includes the detection sensor 103, the temperature sensors 109A and 109B, and the sheet detection sensors 130, 131, 132, 133, and 134 shown in FIG. 1.

The control section 200 determines presence or absence of a sheet on the paper feeding tray 102 on the basis of a signal from the detection sensor 103. The control section 200 detects the temperatures of the heating sections of the decoloring units 108A and 108B using the temperature sensors 109A and 109B and controls the temperatures of the heating sections of the decoloring units 108A and 108B.

The control unit 200 grasps the positions of a sheet in the first to third conveying paths 118, 120, and 122 using the sheet detection sensors 130, 131, 132, 133, and 134. For example, the control section 200 detects, using the sheet detection sensor 130 provided downstream and near the reading section 106, a sheet that passes the reading section 106.

The storing section 210 stores application programs and an OS. The application programs include computer programs for executing functions of the erasing apparatus 100 such as a reading function by the reading section 106 and a decoloring function of the erasing section 108. The application programs further include an application for a Web client (a Web browser) and other applications.

The storing section 210 stores an image read by the reading section 106. The storing section 210 stores the number of processed sheets processed by the erasing apparatus 100. The storing section 210 may be, for example, a hard disk drive or another magnetic storage device, an optical storage device, a semiconductor storage device such as a flash memory, or an arbitrary combination of these devices.

The communication I/F 214 is an interface connected to an external apparatus. The communication I/F 214 communicates with the external apparatus on a network via appropriate radio or wire of IEEE802.15, IEEE802.11, IEEE802.3, IEEE3304, or the like for, for example, Bluetooth (registered trademark), infrared connection, or optical connection.

The communication I/F 214 may further include a USB connection section to which a connection terminal of the USB standard is connected and a parallel interface. The control section 200 communicates with a multifunction peripheral and other external apparatuses via the communication I/F 214. For example, the storing section 210 of the erasing apparatus 100 stores the image read by the reading section 106 as explained above. However, this is not a limitation.

For example, the erasing apparatus 100 may communicate with a user terminal (a personal computer), a multifunction peripheral, or a server, which is the external apparatus, via the communication I/F 214 and store the image in a storing section of the external apparatus. The erasing apparatus 100 only has to readout image data stored in the external apparatus from an operation section of the multifunction peripheral or the user terminal.

If the erasing apparatus 100 includes login and logout functions in order to subject the user to personal authentication, during logout of the erasing apparatus 100, the erasing apparatus 100 may transmit data of an image stored in the RAM 208 or the storing section 210 of the erasing apparatus 100 to the external apparatus and store the data in the external apparatus.

The conveying section 216 includes plural conveying rollers arranged in the first conveying path 118, the second conveying path 120, and the third conveying path 122 and conveying motors that drive the conveying rollers. The control section 200 controls the driving of the conveying motors of the conveying section 216 to thereby control conveying speed of a sheet. The speed for conveying a sheet through the reading section 106 in order to read an image on the sheet is referred to as reading speed. The speed for conveying a sheet through the erasing section 108 in order to erase a color of an image on the sheet is referred to as decoloring speed. The conveying rollers and the conveying motors of the conveying section 216 are explained below.

Figure 4:
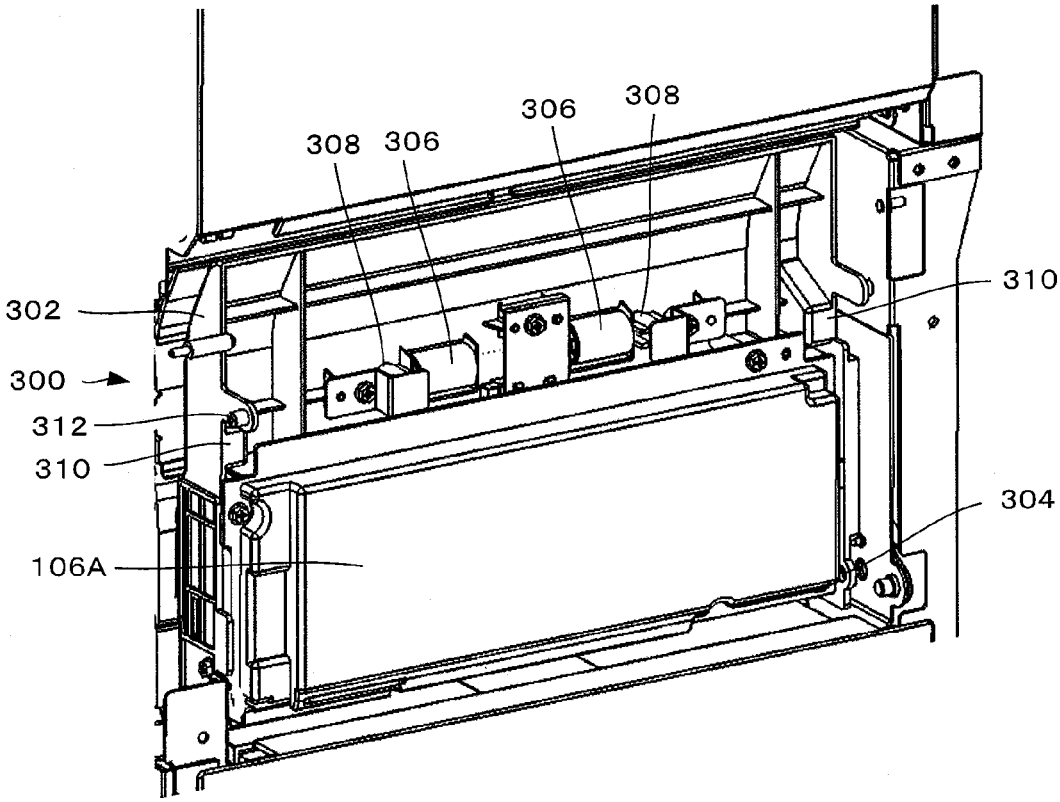
FIG. 4 is a perspective view of a first opening section viewed from the outer side of a machine body.

FIG. 4 is a perspective view of the first opening section 300 viewed from the outer side of the machine body. In FIG. 4, for explanation, the second opening section 400 is not shown. As shown in FIG. 4, the first opening section 300 includes conveyance guide sections 302, the first reading unit 106A, first pivot shafts 304, pinch rollers 306, and elastic members 308 such as springs.

The conveyance guide sections 302 form a part of the first conveying path 118. The conveyance guide sections 302 include receiving sections 310 and coupling pins 312 explained below. The first reading unit 106A is provided on surfaces of the conveyance guide sections 302 on which the first conveying path 118 is formed. The first pivot shafts 304 pivotably support the conveyance guide sections 302. The receiving sections 310 are pressed by pressing sections 408 if the opening section 140 is closed.

Figure 5:
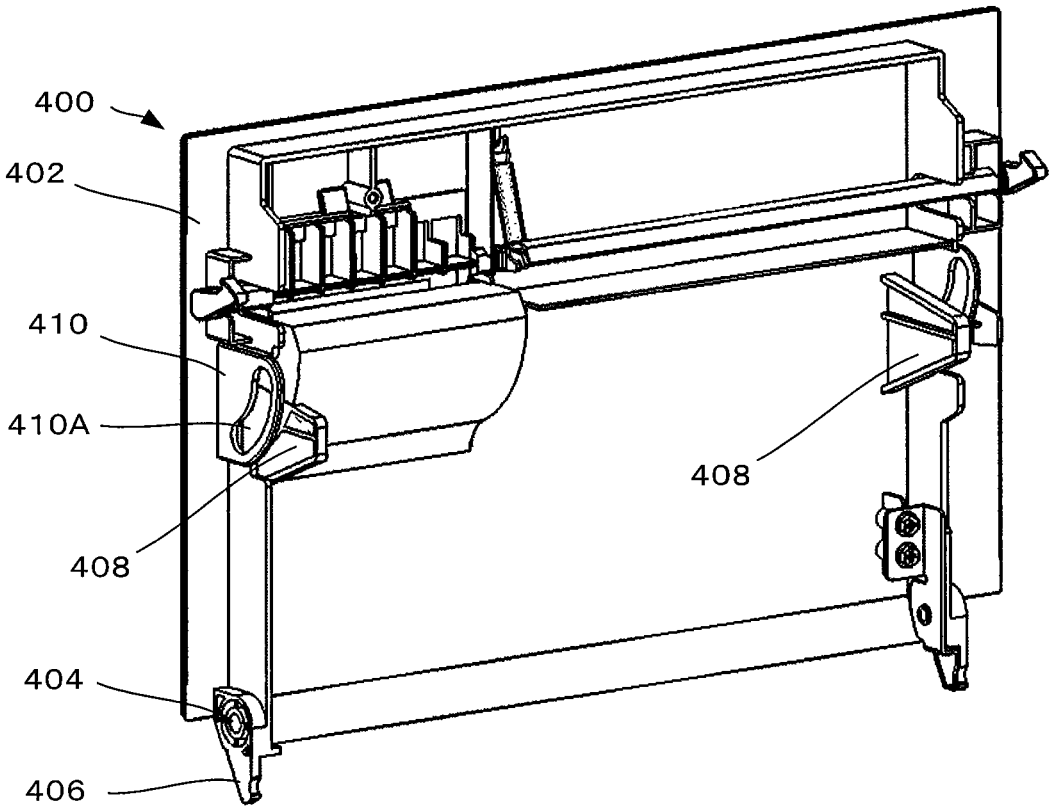
FIG. 5 is a perspective view of a second opening section viewed from the inner side of the machine body.

FIG. 5 is a perspective view of the second opening section 400 viewed from the inner side of the machine body. In FIG. 5, for explanation, the first opening section 300 is not shown. As shown in FIG. 5, the second opening section 400 includes a cover section 402, second pivot shafts 404, and stoppers 406.

The cover section 402 covers the first opening section 300. The second pivot shafts 404 pivotably support the cover section 402.

The stoppers 406 are arranged in positions opposed to each other across the second pivot shafts 404 of the cover section 402. The stoppers 406 regulate the pivoting of the cover section 402. The stoppers 406 are provided below the second pivot shafts 404.

The cover section 402 of the second opening section 400 includes the pressing sections 408 and coupling members 410.

The pressing sections 408 are formed on the first opening section 300 side of the cover section 402. If the opening section 140 is closed, the pressing sections 408 come into contact with the receiving sections 310 of the first opening section 300 and push the first opening section 300 to the first conveying path 118 side.

The pressing sections 408 are provided in the width direction crossing the sheet conveying direction not to interfere with the first reading unit 106A. In this embodiment, the pressing sections 408 are formed on the near side and the depth side of the cover section 402 along the width direction.

The coupling members 410 include coupling holes 410A into which the coupling pins 312 (see FIG. 4) of the conveyance guide sections 302 are inserted.

Figure 6:
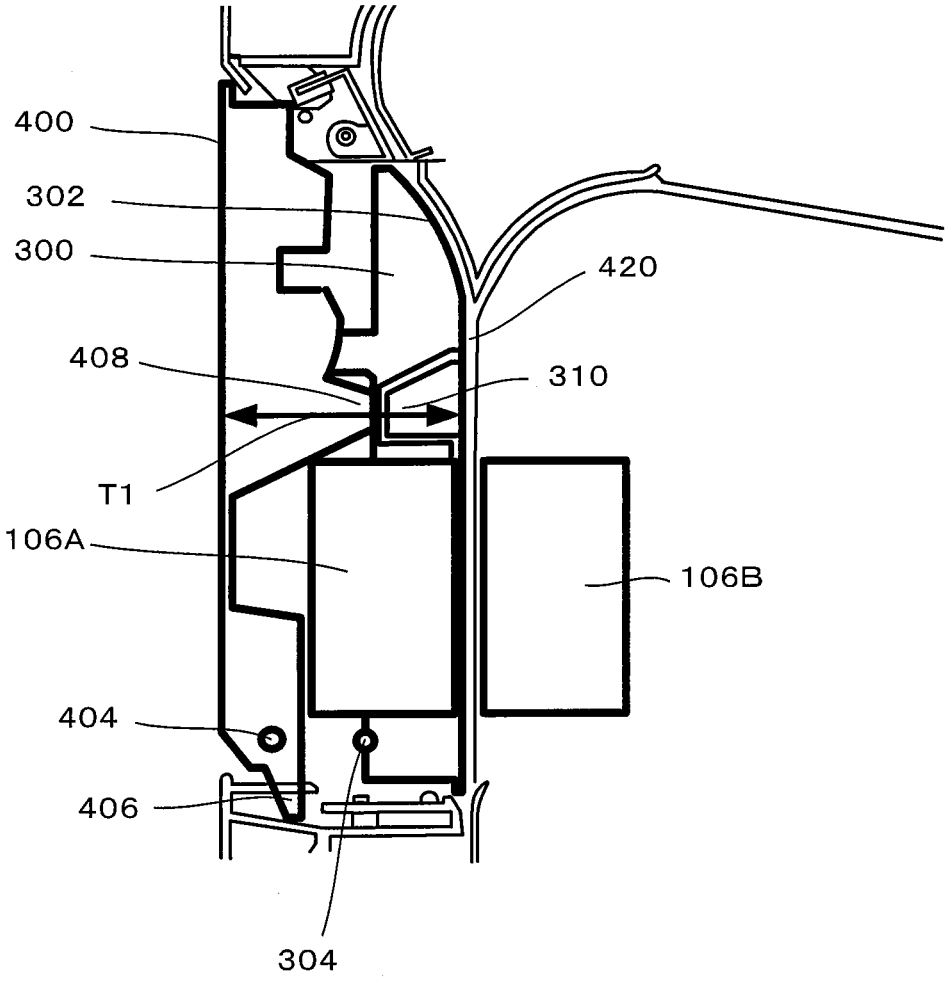
FIG. 6 is a schematic diagram of the vicinity of a pressing section of a closed opening section.
Figure 7:
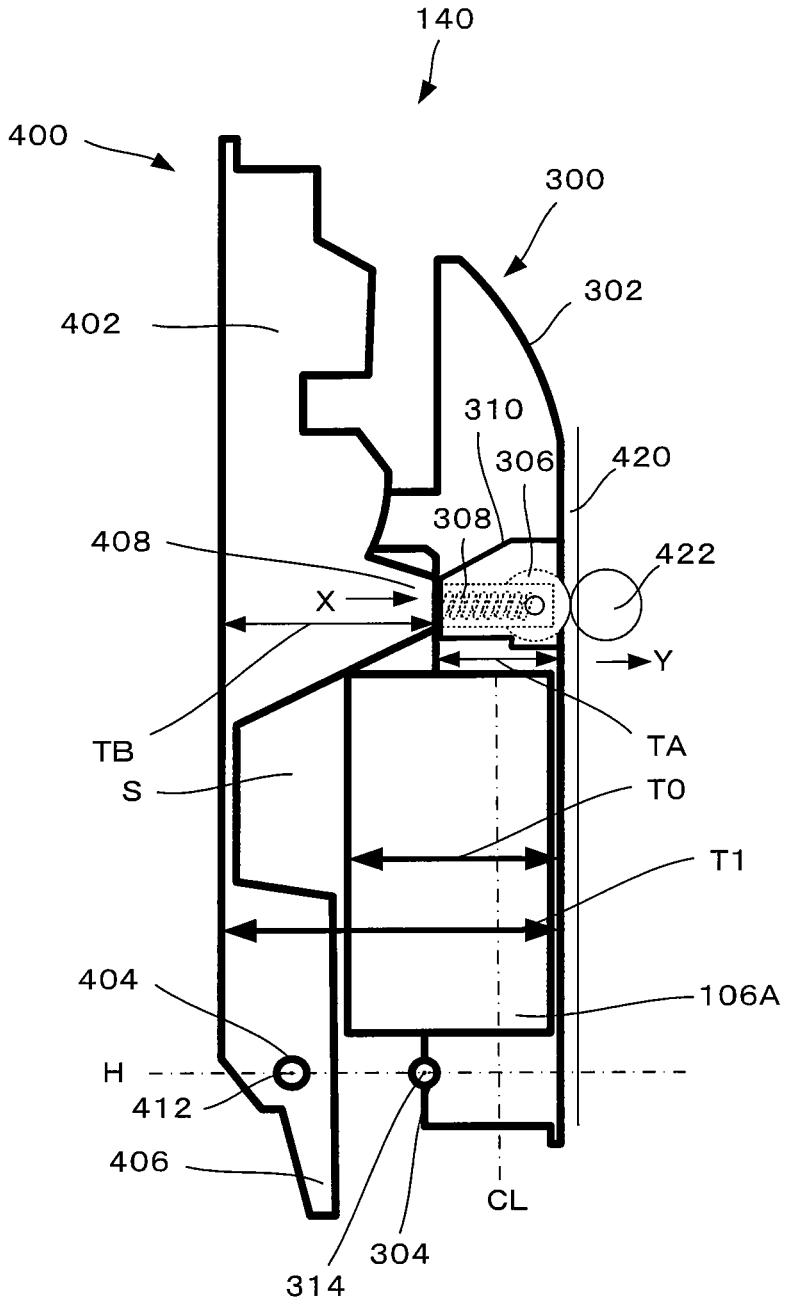
FIG. 7 is a schematic diagram of the vicinity of a driving roller of the closed opening section.

FIGS. 6 and 7 are schematic diagrams for explaining a state in which the opening section 140 is closed (a closed state).

As shown in FIG. 6, if the opening section 140 takes the closed state, the pressing section 408 of the second opening section 400 comes into contact with the distal end of the receiving section 310. In the closed state, the opening section 140 has a thickness T1. In the closed state, a conveying path, which is a part of the first conveying path 118 formed by the conveyance guide section 302, is represented as a conveying path 420.

As shown in FIG. 7, a driving roller 422 is present in a position opposed to the conveyance guide section 302 across the conveying path 420. If the opening section 140 takes the closed state, the pinch roller 306 of the conveyance guide section 302 comes into contact with the driving roller 422. The pinch roller 306 nips a sheet in cooperation with the driving roller 422 and conveys the sheet.

One end of the elastic member 308 is attached to a frame of the conveyance guide section 302. The other end of the elastic member 308 is attached to a rotating shaft of the pinch roller 306.

If the opening section 140 takes the closed state, the pressing section 408 of the second opening section 400 comes into contact with the receiving section 310 and urges the first opening section 300 to the conveying path 420 side (the direction of an arrow X). In this state, the driving roller 422 receives force in the direction of an arrow Y via the pinch roller 306.

Since the driving roller 422 is fixed to the apparatus main body, the elastic member 308 is compressed between the conveyance guide section 302 and the pinch roller 306 that is in contact with the driving roller 422. In other words, the elastic member 308 pushes the conveyance guide section 302 (the first opening section 300) to the second opening section 400 side with a spring force (a repulsion force).

If the cover section 402 of the second opening section 400 is fixed in the closed state by a not-shown lock mechanism, the first opening section 300 is positioned such that the width of the conveying path 420 is fixed.

The opening section 140 in this embodiment includes the first opening section 300 and the second opening section 400 including different pivot shafts. However, with the configuration explained above, a pressing spring and a fastener such as a lock mechanism for independently fixing the first opening section 300 are unnecessary.

The positioning of the first opening section 300 in the closed state is easy. The first reading unit 106A can be provided in the opening section 140.

A first pivot center 314, which is a pivot center shaft of the first pivot shaft 304, shown in FIG. 7 is arranged further on the second opening section 400 side than a center line CL in the direction of a thickness TA of the receiving section 310 of the first opening section 300. A second pivot center 412, which is a pivot center shaft of the second pivot shaft 404, is set on the inside of a thickness TB of the pressing section 408. Consequently, when the opening section 140 is opened, a space below the opening section 140 necessary for the pivoting of the member can be saved.

A straight line H connecting the first pivot center 314 and the second pivot center 412 is desirably substantially horizontal and is most desirably horizontal.

If a thickness T0 of the first reading unit 106A is larger than the thickness of the receiving section 310, the second opening section 400 includes a space S that houses, when the opening section 140 is closed and opened, a portion projecting further to the second opening section 400 than the thickness TA of the receiving section 310.

Specifically, a portion of the first opening section 300 entering the inside of the thickness TB of the second opening section 400 increases as the opening section 140 is opened. The space S houses this increasing portion as well.

Figure 8:
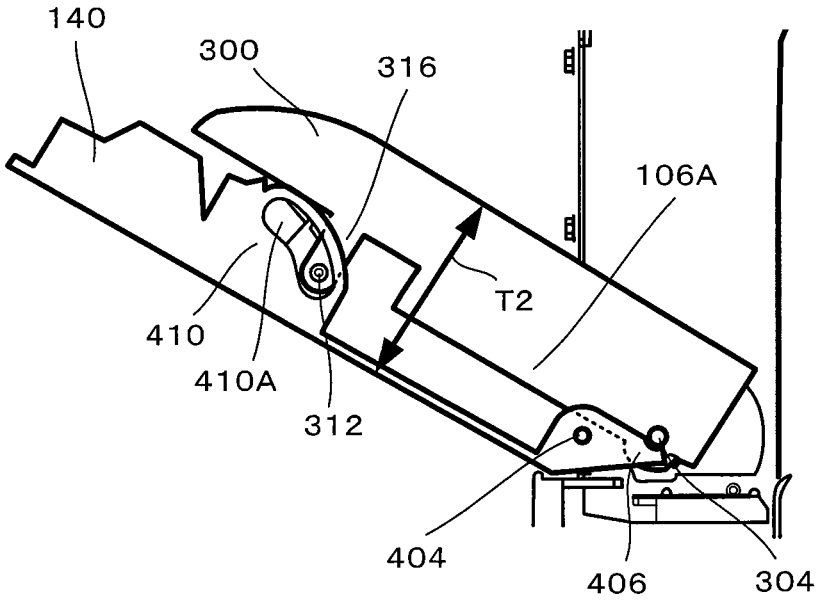
FIG. 8 is a sectional view of the vicinity of an opened opening section.

FIG. 8 is a schematic diagram for explaining a state in which the opening section 140 is opened (an open state). As shown in FIG. 8, the first opening section 300 includes a coupling arm 316 including the coupling pin 312 inserted through the coupling hole 410A of the coupling member 410 of the second opening section 400. The first opening section 300 and the second opening section 400 are connected via the coupling pin 312 and the coupling member 410.

The coupling arm 316 is elastically deformed by force from the outer side direction. Therefore, the first opening section 300 is opened and closed independently from the second opening section 400 by elastically deforming the coupling arm 316 and removing the coupling pin 312 from the coupling hole 410A.

If the opening section 140 in the closed state changes to the open state, i.e., if the second opening section 400 is opened, the coupling pin 312 of the first opening section 300 slides in the coupling hole 410A according to the pivoting of the second opening section 400. Since the first pivot shaft 304 and the second pivot shaft 404 are separate bodies, the first opening section 300 slides to follow the second opening section 400. In other words, the first opening section 300 pivots following the pivoting of the second opening section 400. The coupling hole 410A prevents the first opening section 300 and the second opening section 400 from separating and flopping when the opening section 140 is opened.

When the second opening section 400 pivots to a certain angle, the stopper 406 comes into contact with the first pivot shaft 304. When the stopper 406 comes into contact with the first pivot shaft 304, the second opening section 400 stops and is not opened more.

Thickness T2 of the opened opening section 140 is smaller than the thickness T1 of the closed opening section 140.

The second opening section 400 includes the space S that houses a portion interfering with the first opening section 300. The first opening section 300 and the second opening section 400 includes the pivot shafts different from each other, i.e., the first pivot shaft 304 and the second pivot shaft 404.

Therefore, in the first opening section 300 including the first pivot shaft 304, which is the pivot shaft different from the pivot shaft of the second opening section 400, a portion interfering (overlapping) the second opening section 400 increases as the second opening section 400 is opened. The thickness of the opening section 140 in the open state is smaller than the thickness of the opening section 140 in the closed state.

Figure 9:
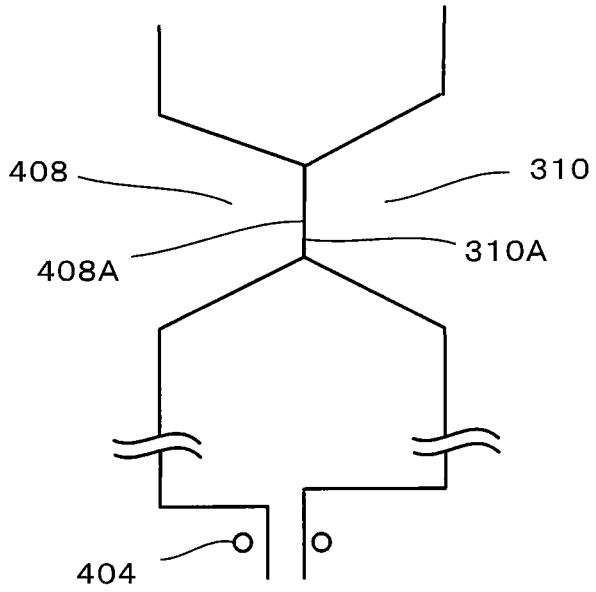
FIG. 9 is a diagram of a state of the pressing section and a receiving section of the closed opening section.
Figure 10:
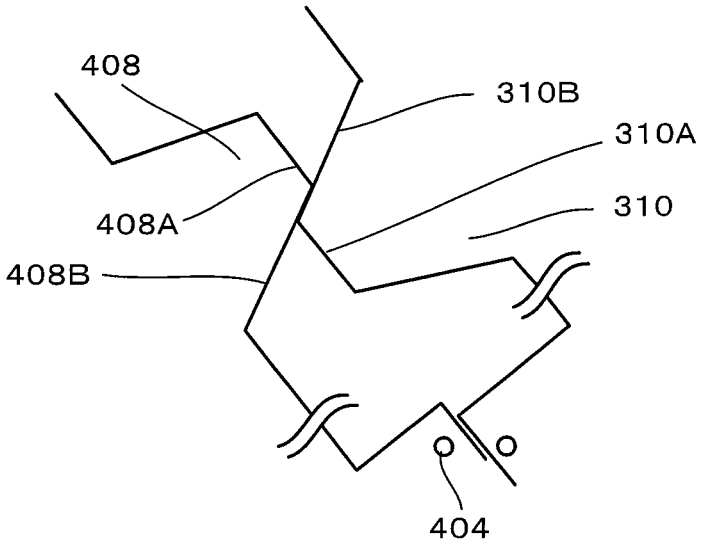
FIG. 10 is a diagram of a state of the pressing section and the receiving section of the opened opening section.

FIGS. 9 and 10 are schematic diagrams for explaining states of the receiving section 310 of the first opening section 300 and the pressing section 408 of the second opening section 400 during opening and closing actions of the opening section 140.

As shown in FIG. 9, in a state in which the opening section 140 is closed, the receiving section 310 and the pressing section 408 are in contact with each other at a first end 310A, which is the distal end of the receiving section 310, and a second end 408A, which is the distal end of the pressing section 408.

When opening of the opening section 140 is started, the second opening section 400 pivots and the coupling pin 312 of the first opening section 300 slides in the coupling hole 410A of the second opening section 400. The second end 408A and the first end 310A slide against each other, whereby the pressing section 408 and the receiving section 310 are displaced.

As shown in FIG. 10, the pressing section 408 and the receiving section 310 assume shapes for maintaining the contact by sliding against each other as the opening section 140 is opened.

For example, the receiving section 310 of the first opening section 300 and the pressing section 408 of the second opening section 400 include a first inclined surface 310B and a second inclined surface 408B that are opposed to each other and slide against each other if the second opening section 400 pivots and the opening section 140 is opened.

If the opening section 140 is in the closed state, the first end 310A and the second end 408A come into contact with each other and determine the positions of the first opening section 300 and the second opening section 400.

When the second opening section 400 starts to pivot, the first opening section 300 also starts to pivot in association with the start of the pivoting of the second opening section 400. The first end 310A and the second end 408A slide against each other.

When the second opening section 400 further pivots, sliding positions of the receiving section 310 and the pressing section 408 change to the first inclined surface 310B and the second inclined surface 408B. The first inclined surface 310B and the second inclined surface 408B in this embodiment have shapes that are parallel to each other while the first inclined surface 310B and the second inclined surface 408B slide against each other.

The first inclined surface 310B and the second inclined surface 408B slide against each other to thereby keep the postures of the first opening section 300 and the second opening section 400 during a pivoting action and prevent the first opening section 300 from being suddenly displaced. In other words, if the second opening section 400 is opened, the first opening section 300 is smoothly opened following the second opening section 400 without shaking.

The shapes of the receiving section 310 and the pressing section 408 are not limited to the shapes explained above. For example, the first inclined surface 310B of the receiving section 310 and the second inclined surface 408B of the pressing section 408 may have curved surfaces.

As explained above, the sheet processing apparatus according to this embodiment includes the first opening section 300 including the conveyance guide section 302 that forms the conveying path 402, through which a conveyed sheet passes, and the first pivot shaft 304 that pivotably supports the conveyance guide section 302, the pinch roller 306 opposed to the fixedly-arranged driving roller 422, and the elastic member 308 that attaches the pinch roller 306 to the conveyance guide section 302 and the second opening section 400 including the cover section 402 that covers the first opening section 300 and the second pivot shaft 404 that pivotably supports the cover section 402. The first opening section 300 includes the reading section 106 that reads the conveyed sheet. The first opening section 300 is pushed to the conveying path 420 side by the second opening section 400. The first opening section 300 fixes the posture thereof in an appropriate position using the repulsion force of the elastic member 308 generated by the contact of the pinch roller 306 with the driving roller 422.

According to the embodiment explained above, the conveying path 420 is made openable by providing the reading section 106 in the opening section 140. Positioning of the reading section 106 is facilitated by providing the reading section 106 in the first opening section 300 including the configuration explained above.

According to the embodiment, even if a member forming the sheet conveying path, which should be opened, is thick, it is possible to open the sheet conveying path sufficiently wide.

In the explanation of the embodiment, the "decoloring processing" is described as erasing a color of an image. However, the "decoloring processing" may include a meaning that an image is erased. In other words, the erasing apparatus according to this embodiment is not limited to an apparatus that erases a color of an image with heat. For example, the erasing apparatus may be either an apparatus that erases a color of an image on a sheet by irradiating light on the sheet or an apparatus that erases an image formed on a special sheet. Alternatively, the erasing apparatus may be an apparatus that removes (erases) an image on a sheet. The erasing apparatus only has to be configured to make an image on a sheet invisible in order to make the sheet reusable.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. A sheet processing apparatus comprising:

a conveying member configured to convey a sheet;

a first opening section including a conveyance guide section arranged on an opposite side of the conveying member across a conveying path for conveying the sheet and configured to form the conveying path and a first pivot shaft configured to pivotably support the conveyance guide section, the first opening section being configured to form the conveying path using the conveyance guide section if changing to a closed state and open the conveying path if changing to an open state; and a second opening section including a cover section configured to cover the first opening section if the first opening section changes to the closed state and a second pivot shaft configured to pivotably support the cover section, the second opening section being configured to cause, if pivoting, the first opening section to pivot following the second opening section.

2. The apparatus according to claim 1, wherein a straight line connecting the first pivot shaft and the second pivot shaft is horizontal.

3. The apparatus according to claim 2, wherein the first opening section includes, in a position facing the conveying path, a reading unit configured to read an image on the sheet.

4. The apparatus according to claim 3, wherein the first opening section includes:

a conveying roller configured to convey the sheet; and an elastic member set in the conveyance guide section and configured to press the conveying roller against the conveying member if the first opening section is closed, and the second opening section includes a pressing section configured to press and close the first opening section if closed.

5. The apparatus according to claim 4, wherein the first opening section includes a receiving section pressed by the pressing section, and the pressing section keeps contact with the receiving section when the second opening section opens and closes.

6. The apparatus according to claim 4, wherein the second opening section includes stoppers arranged in positions opposed to each other across the second pivot shaft of the cover section and configured to regulate an opening action of the second opening section.

7. A sheet conveying path opening method comprising: causing a first opening section to pivot following a second opening section to thereby open a sheet conveying path for conveying a sheet, the first opening section including a conveyance guide section arranged on an opposite side of a conveying member across the sheet conveying path and configured to form the conveying path and a first pivot shaft configured to pivotably support the conveyance guide section, and the second opening section including a cover section configured to cover the first opening section and a second pivot shaft configured to pivotably support the cover section.

8. The method according to claim 7, further comprising: reading an image on the sheet with a reading unit included in the first opening section in a position facing the conveying path.

9. The method according to claim 8, further comprising:

pressing, if the first opening section is closed, a conveying roller, configured to convey the sheet, against the conveying member with an elastic member set in the conveyance guide section of the first opening section; and pressing and closing the first opening section with a pressing section included in the second opening section.

10. The method according to claim 9, further comprising: opening and closing the first opening section and the second opening section while keeping the pressing section and a receiving section, which is provided in the first opening section and pressed by the pressing section, in contact with each other.

11. The method according to claim 10, further comprising: regulating an opening action of the second opening section with stoppers arranged in positions opposed to each other across the second pivot shaft of the cover section.

12. An erasing apparatus comprising:

an erasing section configured to erase an image on a sheet;

a conveying member configured to convey the sheet to the erasing section;

a first opening section including a conveyance guide section arranged on an opposite side of the conveying member across a conveying path for conveying the sheet and configured to form the conveying path and a first pivot shaft configured to pivotably support the conveyance guide section, the first opening section being configured to form the conveying path using the conveyance guide section if changing to a closed state and open the conveying path if changing to an open state; and a second opening section including a cover section configured to cover the first opening section if the first opening section changes to the closed state and a second pivot shaft configured to pivotably support the cover section, the second opening section being configured to cause, if pivoting, the first opening section to pivot following the second opening section.

13. The apparatus according to claim 12, wherein a straight line connecting the first pivot shaft and the second pivot shaft is horizontal.

14. The apparatus according to claim 13, wherein the first opening section includes, in a position facing the conveying path, a reading unit configured to read an image on the sheet.

15. The apparatus according to claim 14, wherein the first opening section includes:

a conveying roller configured to convey the sheet; and an elastic member set in the conveyance guide section and configured to press the conveying roller against the conveying member if the first opening section is closed, and the second opening section includes a pressing section configured to press and close the first opening section if closed.

16. The apparatus according to claim 15, wherein the first opening section includes a receiving section pressed by the pressing section, and the pressing section keeps contact with the receiving section when the second opening section opens and closes.

17. The apparatus according to claim 15, wherein the second opening section includes stoppers arranged in position opposed to each other across the second pivot shaft of the cover section and configured to regulate an opening action of the second opening section.

* * * * *